US006992646B2

(12) United States Patent
Setoguchi et al.

(10) Patent No.: US 6,992,646 B2
(45) Date of Patent: Jan. 31, 2006

(54) PLASMA DISPLAY PANEL

(75) Inventors: Noriaki Setoguchi, Kawasaki (JP); Seiki Kurogi, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 389 days.

(21) Appl. No.: 10/391,760

(22) Filed: Mar. 20, 2003

(65) Prior Publication Data

US 2003/0184226 A1 Oct. 2, 2003

(30) Foreign Application Priority Data

Mar. 28, 2002 (JP) ..... 2002-090811

(51) Int. Cl.
*G09G 3/28* (2006.01)

(52) U.S. Cl. ..... 345/67; 313/492

(58) Field of Classification Search ..... 345/60, 345/61, 62, 66, 67, 68; 313/484, 491, 492
See application file for complete search history.

(56) References Cited

U.S. PATENT DOCUMENTS

2003/0080926 A1 * 5/2003 Morimoto ..... 345/60
2003/0193487 A1 * 10/2003 Yatsuda et al. ..... 345/204

FOREIGN PATENT DOCUMENTS

JP 04-058437 2/1992
JP 2001-126629 5/2001

* cited by examiner

*Primary Examiner*—Dennis-Doon Chow
(74) *Attorney, Agent, or Firm*—Staas & Halsey LLP

(57) ABSTRACT

A plasma display panel including a first substrate carrying thereon a plurality of strip-shaped ribs arranged parallel to each other, a fluorescent material applied between adjacent ribs and a plurality of address electrodes arranged parallel to the ribs and a second substrate being arranged to oppose to the first substrate and carrying thereon a plurality of sustain electrodes arranged in a direction crossing the address electrodes, wherein each of the address electrodes between adjacent ribs includes a plurality of branch electrodes which are diverged through almost the whole length of the ribs.

3 Claims, 9 Drawing Sheets

PLASMA DISPLAY PANEL

CROSS-REFERENCE TO RELATED APPLICATION

This application is related to Japanese application No. 2002-090811 filed on Mar. 28, 2002, whose priority is claimed under 35 USC §119, the disclosure of which is incorporated by reference in its entirety.

BACKGROUND OF THE INVENTION

1. Field of the Invention

The present invention relates to a plasma display panel in which a light emitting region is selected by an address electrode and display is performed by making use of gas discharge between a pair of sustain electrodes. In particular, it relates to a plasma display panel having the address electrodes of improved structure.

2. Description of Related Art

A prior art plasma display panel of this kind is disclosed by Japanese Unexamined Patent Publication No. 2001-126629. Explanation thereof is given below with reference to FIGS. 8(A), 8(B) and 8(C). FIG. 8(A) is a view illustrating positional relationship between sustain electrodes and address electrodes in the prior art plasma display panel and FIGS. 8(B) and 8(C) are sectional views taken along the lines b—b and c—c in FIG. 8(A) and observed in the direction of the arrows, respectively.

Referring to these figures, the prior art plasma display panel includes a plurality of second sustain electrodes 113 for selecting lines, a plurality of first sustain electrodes 114 and a plurality of address electrodes for selecting lines. Discharge space is divided in a column direction by almost linear-shaped ribs 224 to extend over the whole length of the screen. Further, in a region between adjacent ribs 224, the address electrode 222 is patterned to overlap the first sustain electrode 114 in a smaller area than a metal film 113*a* of the second sustain electrode 113.

Since the shape or the position of the address electrode 222 is selected with a view of reducing an area in which the address electrode 222 overlaps the first sustain electrode 114 which is unrelated to the line selection via the discharge space, an area in which the address electrode 222 overlaps the second sustain electrode 113 which is used for line selection is sufficiently increased. Therefore, address discharge is localized in the overlapping region of the address electrode 222 and the second sustain electrode 113, which ensures the reliability of the address discharge.

Another prior art plasma display panel is disclosed by Japanese Unexamined Patent Publication No. HEI 4 (1992)-58437. Explanation thereof is given below with reference to FIG. 9. FIG. 9 is a perspective view partially illustrating the prior art plasma display panel.

Referring to FIG. 9, the plasma display panel includes a plurality of unit light emitting regions P including a fluorescent material 225 for selectively emitting light by discharge, a plurality of sustain electrode pairs 110 each including a second sustain electrode 113 and a first sustain electrode 114 and being arranged parallel to each other and address electrodes 222 crossing the sustain electrode pairs 110. The second and first sustain electrodes 113 and 114 cause surface discharge in a narrow region along their extending direction to constitute the unit light emitting region P and the address electrode 222 is divided in two or more in each unit light emitting region P.

In the plasma display panel thus constructed, the second sustain electrode 113 of the sustain electrode pair 110 extending along a longitudinal center line of the unit light emitting region P intersects, via the discharge space, with two address electrodes 222 which are commonly connected, thereby defining select discharge cells WC at the intersections. That is, the two select discharge cells WC control discharge caused in sustain discharge cells SC defined at the intersections of the two address electrodes 222 and the second and first sustain electrodes 113 and 114. Accordingly, a single select discharge cell WC takes charge of discharge control in about a half area of the unit light emitting region P, which allows reliable control of the light emission from the fluorescent material 225 corresponding to the unit light emitting region P.

Since the former plasma display panel according to the prior art is constructed as described above, expansion of address discharge in the column direction in the selected line is inhibited so that a charged region of the address electrode 222 is narrowed. However, due to the address discharge, a potential level of the address electrode 222 in an adjacent unit light emitting region P decreases. Therefore, addressing of the adjacent unit light emitting region P cannot be performed with reliability.

On the other hand, in the latter plasma display panel according to the prior art, the address electrode 222 is divided in two or more in each unit light emitting region P as described above. However, an interval between the divided address electrodes 222 is small. As a result, all the divided address electrodes 222 are charged upon causing address discharge between the second sustain electrode 113 and one of the address electrodes 222. Therefore, in the same manner as the former plasma display panel according to the prior art, a potential level of the address electrode 222 in an adjacent unit light emitting region P decreases and precise addressing of the adjacent unit light emitting region P cannot be performed.

SUMMARY OF THE INVENTION

The plasma display panel according to the present invention comprises a first substrate carrying thereon a plurality of strip-shaped ribs arranged parallel to each other, a fluorescent material applied between adjacent ribs and a plurality of address electrodes arranged parallel to the ribs and a second substrate being arranged to oppose to the first substrate and carrying thereon a plurality of sustain electrodes arranged in a direction crossing the address electrodes, wherein each of the address electrodes between adjacent ribs includes a plurality of branch electrodes which are diverged through almost the whole length of the ribs. Therefore, even in the case where address discharge occurs between one of the branch electrodes and the sustain electrode to generate charges in the branch electrode and decrease a potential level of the branch electrode, the other branch electrodes maintain a sufficient potential level so that stable address discharge is caused with the sustain electrode.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
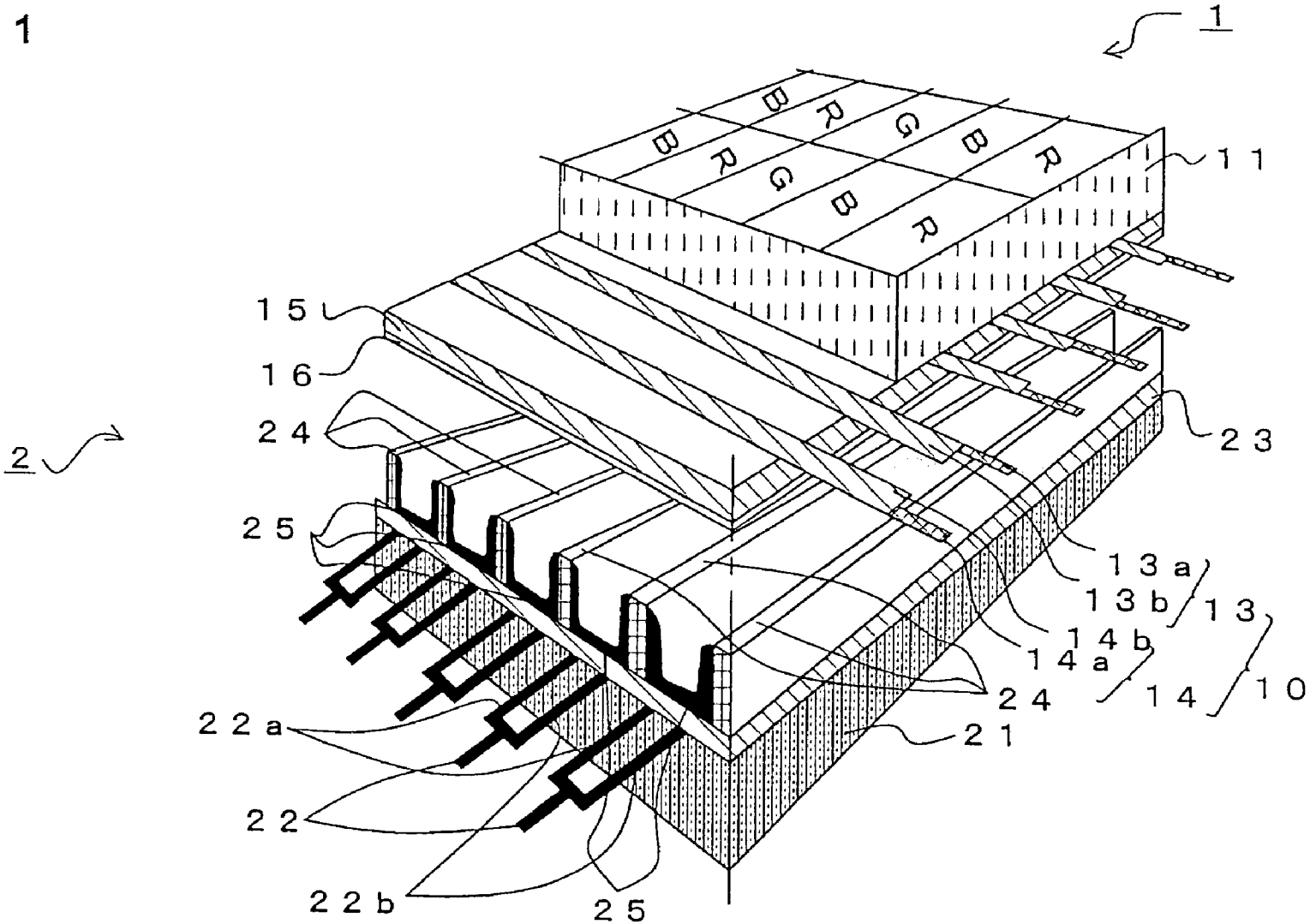
FIG. 1 is a perspective view partially illustrating a plasma display according to Embodiment 1 of the present invention.

The present invention provides a plasma display panel which inhibits unintended influence of the address discharge on an adjacent unit light emitting region to carry out the address discharge smoothly in the adjacent line.

The plasma display panel according to the present invention comprises a first substrate carrying thereon a plurality of strip-shaped ribs arranged parallel to each other, a fluorescent material applied between adjacent ribs and a plurality of address electrodes arranged parallel to the ribs and a second substrate being arranged to oppose to the first substrate and carrying thereon a plurality of sustain electrodes arranged in a direction crossing the address electrodes, wherein each of the address electrodes between adjacent ribs includes a plurality of branch electrodes which are diverged through almost the whole length of the ribs.

More particularly, in one address period, when adjacent cells in the column direction are continuously selected for address discharge, any two adjacent cells can be selected by one of the branch electrodes and other of the branch electrodes, respectively, even if the potential level of said one of the branch electrodes drops due to the address discharge.

Here the address period means a period of addressing within a time range during which a wall charge on the address electrode has influence on the addressing of a next line (until initialization is carried out in a reset period).

Also, here, the adjacent cells are cells addressed successively in the column direction in the address period, meaning not only cells located next to each other in the column direction, but also successive cells in every two lines in the case of interlaced addressing.

The cells adjacent in the longitudinal direction are not always right next to each other. In the case of interlaced scanning mode, the addressing is performed in every other line in the single address period.

Further, in the plasma display panel according to the present invention, the branch electrodes formed between the adjacent ribs have wide portions corresponding to the sustain electrodes, respectively, the wide portions of the branch electrodes being formed so as not to be adjacent to each other. Therefore, in the case where address discharge occurs between one of the branch electrodes and the sustain electrode to generate charges in the branch electrode, the charges are concentrated in the wide portion of the branch electrode. As a result, the other branch electrodes maintain a sufficient potential level to cause stable address discharge with the sustain electrode.

Still further, in the plasma display panel according to the present invention, the branch electrodes formed between the adjacent ribs are connected in each unit light emitting region or in every two or more unit light emitting regions. Therefore, stable address discharge is caused and continuity is ensured even in the case of a break in part of the address electrode. Thus, high reliability is achieved.

Embodiment 1

Figure 2:
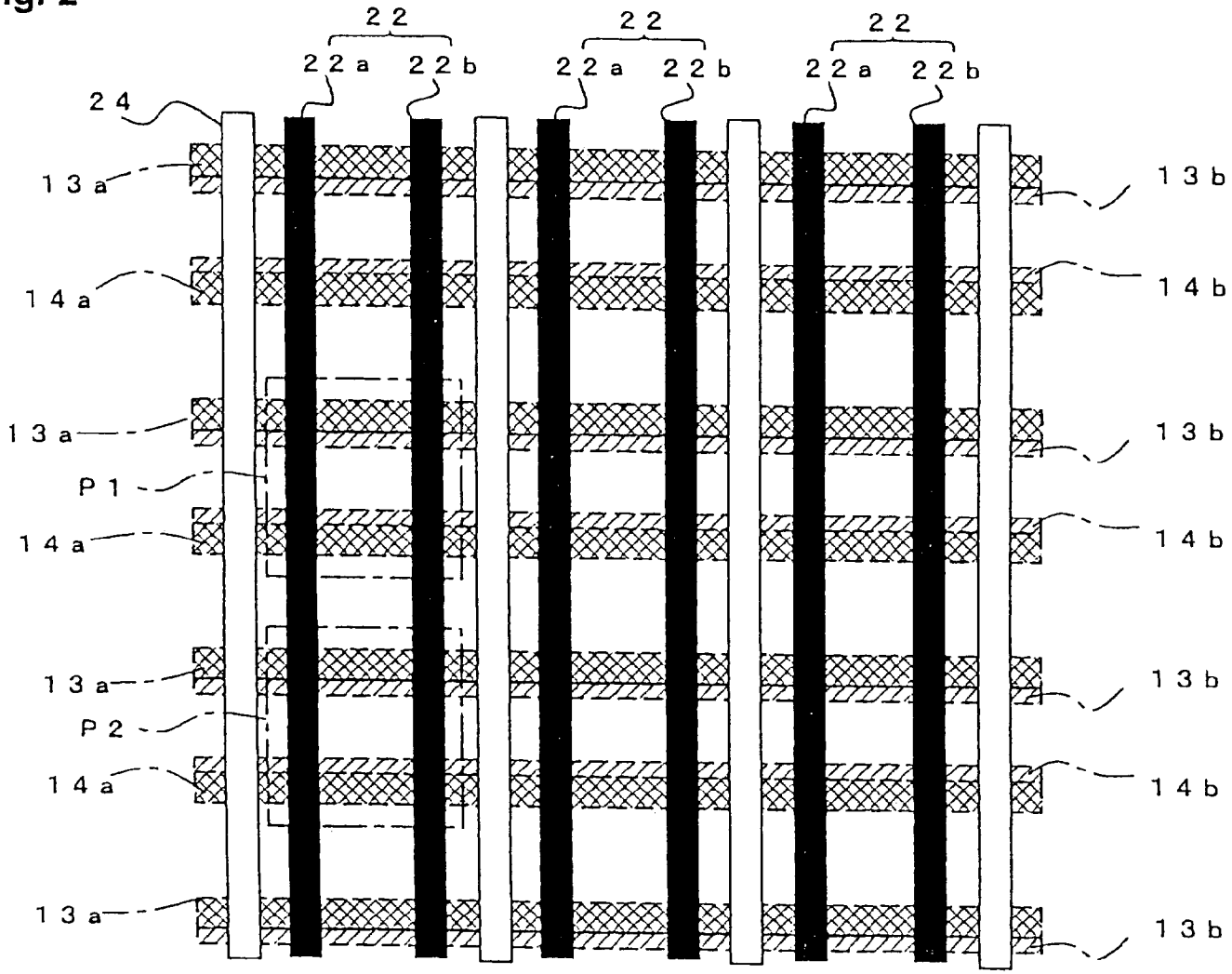
FIG. 2 is a view illustrating electrode structure on a rear substrate of the plasma display panel according to Embodiment 1 of the present invention.
Figure 3:
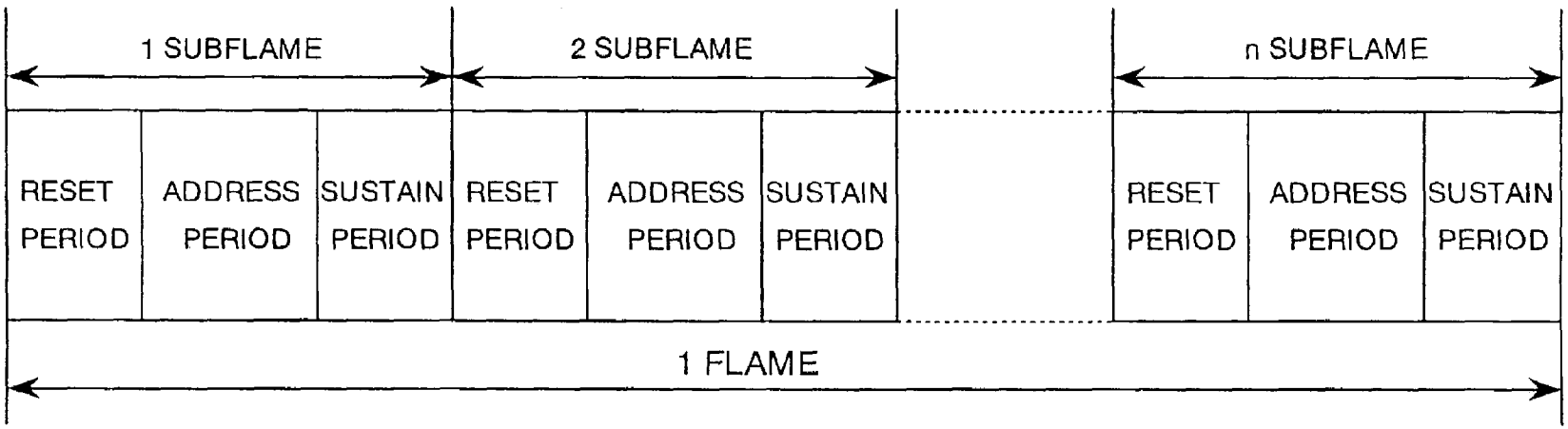
FIG. 3 is a view illustrating frames for driving the plasma display panel according to Embodiment 1 of the present invention.
Figure 4:
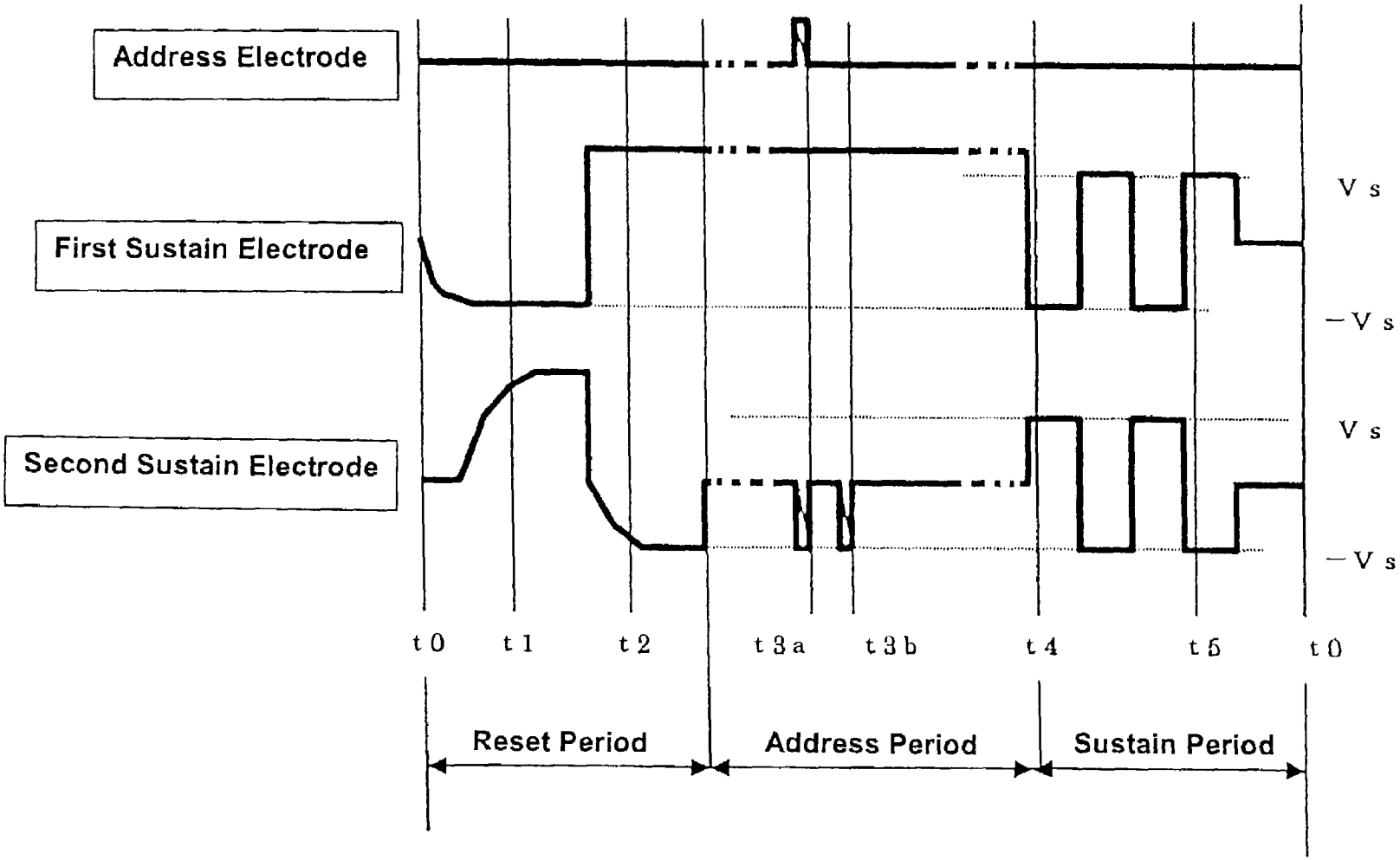
FIG. 4 is a view illustrating voltage waveforms for driving the plasma display panel according to Embodiment 1 of the present invention.
Figure 5:
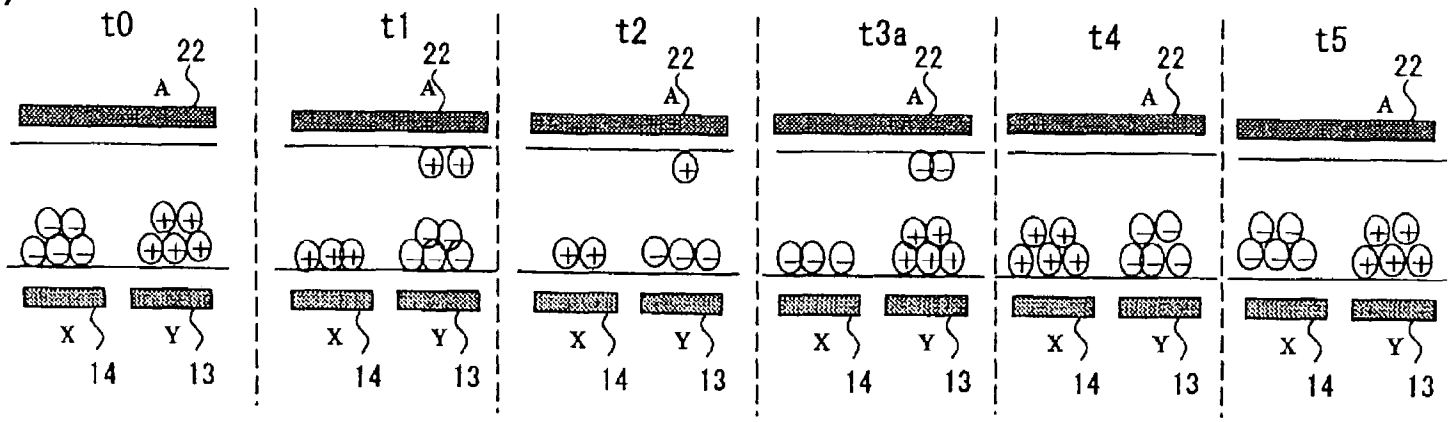
FIGS. 5(A) and 5(B) are views each illustrating the state of wall charges correlated with the voltage waveforms of FIG. 4.
Figure 5:
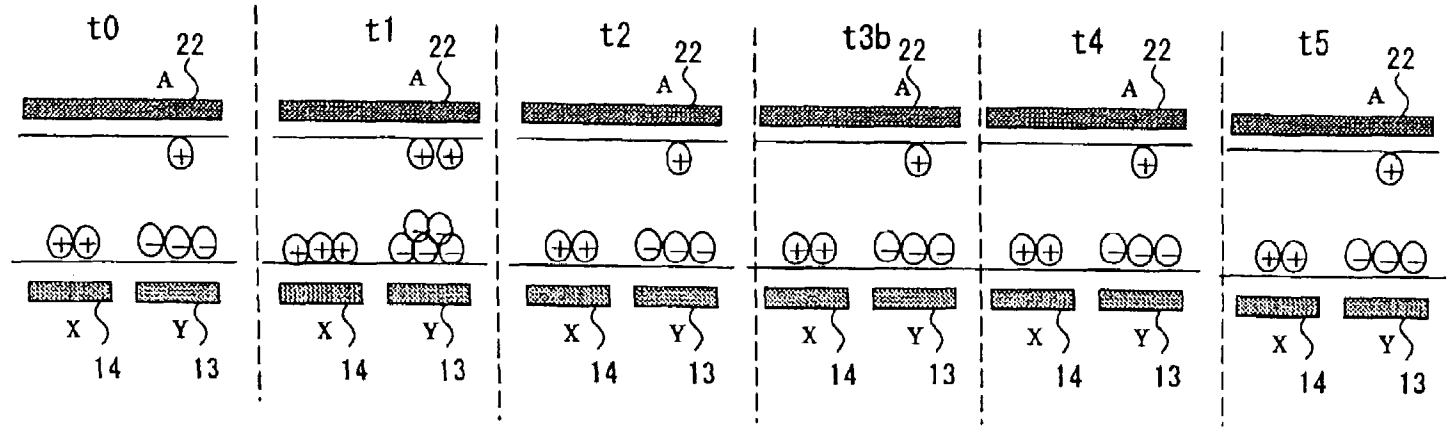

A plasma display panel according to Embodiment 1 of the present invention is described with reference to FIGS. 1 to 5(B). FIG. 1 is a perspective view partially illustrating a plasma display according to this embodiment, FIG. 2 is a view illustrating electrode structure on a rear substrate of the plasma display panel according to this embodiment, FIG. 3 is a view illustrating frames for driving the plasma display panel according to this embodiment, FIG. 4 is a view illustrating voltage waveforms for driving the plasma display panel according to this embodiment and FIGS. 5(A) and 5(B) are views illustrating the state of wall charges correlated with the voltage waveforms of FIG. 4.

Referring to these figures, the plasma display panel according to this embodiment includes a front substrate 1 on which sustain electrode pairs 10 are formed, a rear substrate 2 on which address electrodes 22 are formed and discharge gas of a mixture of xenon and neon filled between the substrates arranged to be opposed to each other. More specifically, the front substrate 1 includes first sustain electrodes 14 and second sustain electrodes 13 arranged in pairs and parallel to each other on an inner surface of a glass substrate 11 which serves as a base material of the front substrate 1, a dielectric layer 15 covering the first and second sustain electrodes 14 and 13 and a protective layer 16 of MgO covering the surface of the dielectric layer 15. The first sustain electrodes 14 and the second sustain electrodes 13 are used in pairs to cause sustain discharge for display and include narrow bus electrodes 14*a* and 13*a* to which voltage is supplied from a driving circuit (not shown) and wide transparent conductive films 14*b* and 13*b* for causing sustain discharge (main discharge), respectively.

The rear substrate 2 includes address electrodes 22 arranged on an inner surface of a glass substrate 21 which serves as a base material of the rear substrate 2 in a direction crossing the sustain electrode pairs 10, a dielectric layer 23 covering the address electrodes 22 and ribs 24 arranged on the dielectric layer 23 in a direction parallel to the address electrodes to divide discharge space.

Each of the address electrodes 22 on the rear substrate 2 includes two branch electrodes 22*a* and 22*b* which are diverged through the whole length between adjacent ribs 24 and arranged orthogonally to the sustain electrode pairs 10 of the front substrate 1. A region where the branch electrodes intersect with the sustain electrode pairs constitutes a unit light emitting region. By applying negative voltage to the second sustain electrode 13 and positive voltage to the address electrode 22, the voltage of the second sustain electrode 13 and the voltage of one of the branch electrodes 22*a* and 22*b* exceed starting voltage. Thereby, address discharge is caused to perform addressing for selecting the unit light emitting region. Due to the address discharge, negative charges are generated in one of the branch electrodes 22*a* (or 22*b*). Accordingly, address discharge does not occur between the second sustain electrode 13 and the branch electrode 22*a* (or 22*b*), while it is caused between the second sustain electrode and the other branch electrode 22*b* (or 22*a*) in which negative charges are not generated. Thereafter, the branch electrodes 22*a* and 22*b* alternately cause the address discharge with the second sustain electrode 13.

In concave grooves which are discharge spaces defined by the ribs 24 and the dielectric layer 23 of the rear substrate 2, fluorescent material layers 25 of R, G and B are formed one by one. Light emission is obtained by exciting the fluorescent material layers 25 with ultraviolet rays generated by sustain discharge. A color tone of a pixel is determined by light emission intensity of R, G and B.

Next, explanation is given of image display operations in a plasma display device to which the plasma display panel according to this embodiment is applied.

A single frame for displaying a single screen includes a plurality of subframes (e.g., 8 subframes) (see FIG. 3). Each of the subframes includes a reset period for regularizing charge distribution in the unit light emitting regions of the entire panel, an address period for causing address discharge between the address electrode 22 and the second sustain electrode 13 to generate wall charges, thereby selecting light emission of the unit light emitting region P for display and a sustain period for causing discharge between the paired first sustain electrode 14 and second sustain electrode 13 by making use of the wall charges to sustain the light emission of the unit light emitting region P.

During the above-described periods, voltages having the waveforms shown in FIG. 4 are applied to the address electrode 22, the first sustain electrode 13 and the second sustain electrode 14, respectively. FIGS. 5(A) and 5(B) are views each illustrating the state of wall charges correlated with the driving waveforms of FIG. 4. The former shows the case where light emission is caused in a unit light emitting region P which emits light in the initial state, while the latter shows the case where light emission is not caused in a unit light emitting region P which does not emit light in the initial state.

In the reset period, a negative pulse is applied to the first sustain electrodes 14 and a positive pulse is applied to the second sustain electrodes 13 to cause discharge in all the unit light emitting regions P forming the screen, whether they are emitting light (at time t0 in FIG. 5(A)) or not (at time 0 in FIG. 5(B)). Thereby, as shown in time t1 in FIGS. 5(A) and 5(B), negative charges are generated in the second sustain electrodes 13 and positive charges are generated in the first sustain electrodes 14 and the address electrodes 22. Then, with respect to all the unit light emitting regions P, a positive pulse is applied to the first sustain electrodes 14 and a negative pulse is applied to the second sustain electrodes 13 in a reverse manner as described above such that only a predetermined amount of wall charges remains as illustrated in time 2 in FIGS. 5(A) and 5(B). Thus, wall charges are generated uniformly in every unit light emitting region P.

In the address period, a predetermined amount of wall charges is generated only in a unit light emitting region P from which light shall be emitted. As shown in time t3*a* of FIG. 4, a scan pulse is applied to the second sustain electrodes 13 in sequence and an address pulse is applied to the address electrode 22 corresponding to the light emitting region P from which light shall be emitted. Only in the unit light emitting region P corresponding to the second sustain electrode 13 to which the scan pulse is applied and the branch electrodes 22*a* and 22*b* of the address electrode 22 to which the address pulse is applied, address discharge occurs between the second sustain electrode 13 and the address electrode 22. Thereby, positive charges are generated in the second sustain electrode 13 and negative charges are generated in the first sustain electrode 14 and the address electrode 22 at time t3*a* in FIG. 5(A) to generate a predetermined amount of wall charges. Since the address electrode 22 includes the branch electrodes 22*a* and 22*b*, the negative charges are generated in either of the branch electrodes 22*a* and 22*b*.

For example, if the negative charges have already been generated in the branch electrode 22*a* upon addressing a unit light emitting region P1 (see FIG. 2), address discharge is not caused between the second sustain electrode 13 and the branch electrode 22*a* in an adjacent unit light emitting region P2. However, the address discharge in the adjacent unit light emitting region P2 occurs between the second sustain electrode 13 and the branch electrode 22*b* in which the negative charges have not been generated.

Thereafter, in the same manner as the above, address discharge is caused in all the unit light emitting regions P from which light shall be emitted to generate a predetermined amount of wall charges, and then the address period is finished. In this case, the wall charges are generated by causing address discharge only in the unit light emitting regions from which light shall be emitted (so-called write addressing). However, it is also possible to generate the predetermined amount of wall charges in advance in all the unit light emitting regions P forming the screen, and then cause the address discharge to erase the wall charges from the unit light emitting regions P from which light shall not be emitted (so-called erase addressing). The same effect is achieved in both cases.

In the sustain period, a negative pulse is applied as a sustain pulse to the first sustain electrodes 14 and a positive pulse is applied to the second sustain electrodes 13 to cause surface discharge between the first sustain electrode 14 and the second sustain electrode 13 corresponding to the unit light emitting regions P containing the predetermined amount of wall charges generated during the address period. Thereby, negative charges are generated in the second sustain electrode 13 and positive charges are generated in the first sustain electrode 14 to generate a predetermined amount of wall charges at time t4 in FIG. 5(A). Subsequently, a positive pulse is applied to the first sustain electrodes 14 and a negative pulse is applied to the second sustain electrodes 13 to cause surface discharge in the unit light emitting regions P containing the predetermined amount of wall charges in the same manner as described above. Thereby, positive charges are generated in the second sustain electrode 13 and negative charges are generated in the first sustain electrode 14 to generate a predetermined amount of wall charges again at time 5 in FIG. 5(A).

In the case where light is not emitted from the unit light emitting region P which does not emit light in the initial state, the address pulse at time t3*a* in FIG. 4 is not applied during the address period and the sustain pulse is lower than a starting voltage between the first and second sustain electrodes 14 and 13 during the sustain period. Thereby, the surface discharge does not occur between the first and second sustain electrodes 14 and 13. Therefore, the wall charges do not change and remain the state at time t2 in FIG. 5(B) during the address period and the sustain period.

In the case where light is not emitted from the unit light emitting region P which emits light in the initial state, the state of wall charges changes from time t0 to t1 and t1 to t2 shown in FIG. 5(A) during the reset period. During the address period and the sustain period, the wall charges do not change from the state at t2 in FIG. 5(A) in the same manner as the above-described case. That is, the state at time t3 to t5 in FIG. 5(B) is kept.

In the case where light is emitted from the unit light emitting region P which does not emit light in the initial state, the state of wall charges changes from time t0 to t1 and t1 to t2 shown in FIG. 5(B) during the reset period. During the address period and the sustain period, the wall charges change from the state at time t2 to t3*a*, t3*a* to t4 and t4 to t5 shown in FIG. 5(A).

The gradation display on the plasma display panel is performed by changing duration of the sustain periods in the subframes to change the number of light emission. For example, by changing the duration of the sustain periods (the number of light emission) in 8 subframes in the ratio of 1:2:4:8:16:32:64:128, 256-level gradation is realized in every unit light emitting region P. Since a single pixel is made of three unit light emitting regions P, full-color display of 16,770,000 (=256×256×256) colors is achieved.

In the plasma display panel according to this embodiment, address discharge occurs between one of the branch electrodes 22*a* (or 22*b*) and the second sustain electrode 13 to generate charges in the branch electrode 22*a* (or 22*b*) and decrease a potential level of the branch electrode 22*a* (or 22*b*). However, since the other branch electrode 22*b* (or 22*a*) in which charges are not generated has a sufficient potential level, stable address discharge is caused between an adjacent second sustain electrode 13 and the branch electrode 22*b* (or 22*a*).

Embodiment 2

Figure 6:
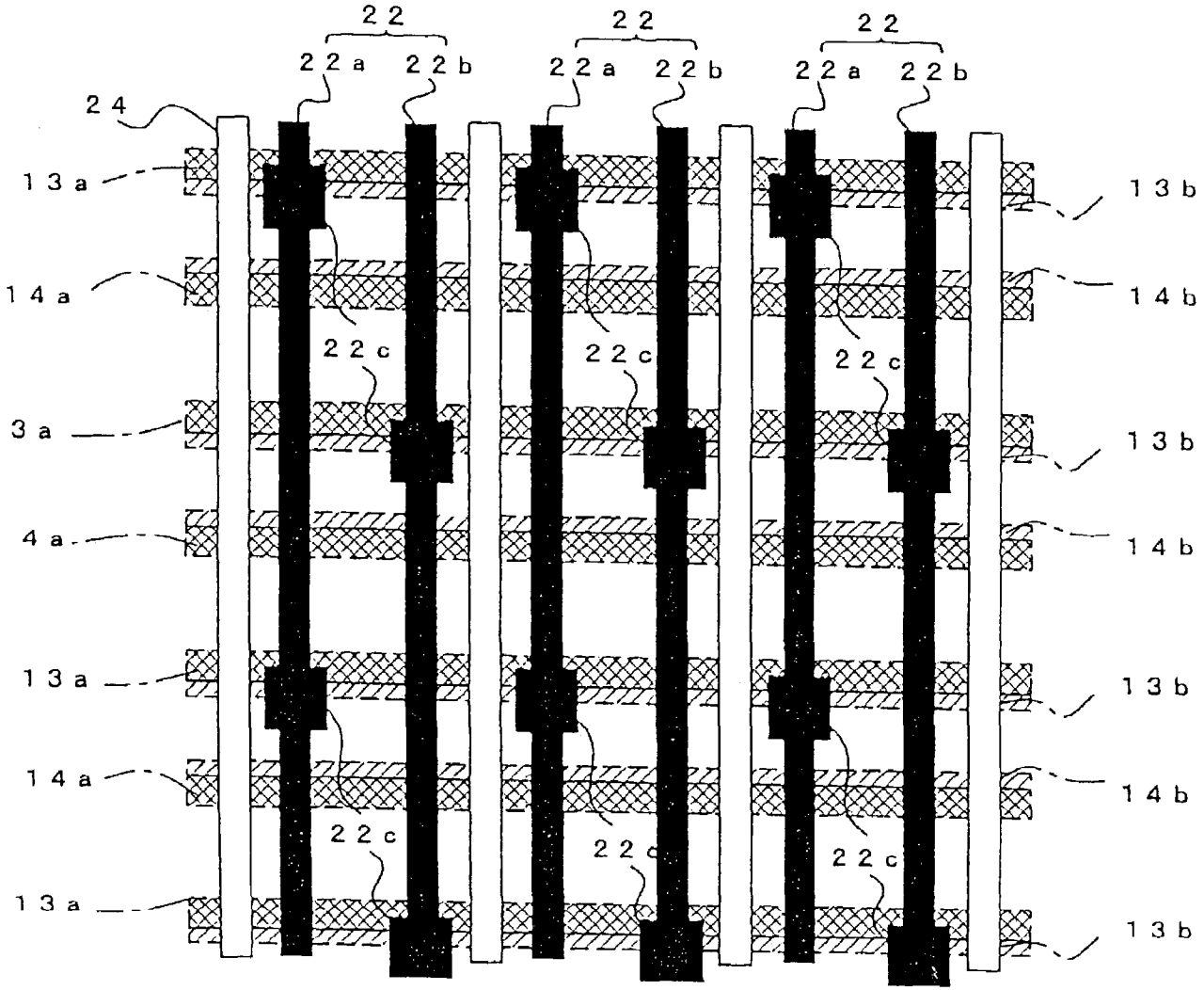
FIG. 6 is a view illustrating electrode structure on a rear substrate of a plasma display panel according to Embodiment 2 of the present invention.

A plasma display panel according to Embodiment 2 of the present invention is described with reference to FIG. 6. FIG. 6 is a view illustrating electrode structure on a rear substrate of the plasma display panel according to this embodiment.

The plasma display panel according to this embodiment is constructed in the same manner as that of Embodiment 1 except that each of the branch electrodes 22*a* and 22*b* formed between adjacent ribs 14 includes a wide portion 22*c* formed in a position corresponding to the second sustain electrode 13. The wide portions 22*c* of the branch electrodes 22*a* and 22*b* between the adjacent ribs 24 are formed so as not to be adjacent to each other.

The branch electrodes 22*a* and 22*b* each having the wide portion 22*c* increase their surface areas, thereby containing a larger amount of positive charges. Even if negative charges are generated in the branch electrodes 22*a* and 22*b* due to the address discharge with the second sustain electrode 13, most of them are accumulated in the wide portions 22*c*. That is, the negative charges are not generated in the branch electrodes 22*a* and 22*b* corresponding to an adjacent second sustain electrode 13. Thus, address discharge continues between the following second sustain electrodes 13 and the branch electrodes 22*a* and 22*b*.

The plasma display panel as constructed above according to this embodiment is operated in the same manner as described in Embodiment 1. However, since the branch electrodes 22*a* and 22*b* have the wide portions 22*c* corresponding to the second sustain electrodes 13, charges are concentrated in the wide portion 22*c* of the branch electrode 22*a* (or 22*b*) upon address discharge between the branch electrode 22*a* (or 22*b*) and the second sustain electrode 13. Thereby, the charges are not generated in the branch electrode 22*b* (or 22*a*) and a sufficient potential level is maintained in the branch electrode 22*b* (or 22*a*). Accordingly, address discharge between the branch electrode 22*b* (or 22*a*) and an adjacent second sustain electrode 13 is caused. Thereafter, the address discharge occurs in the same manner, which allows stable addressing.

Embodiment 3

Figure 7:
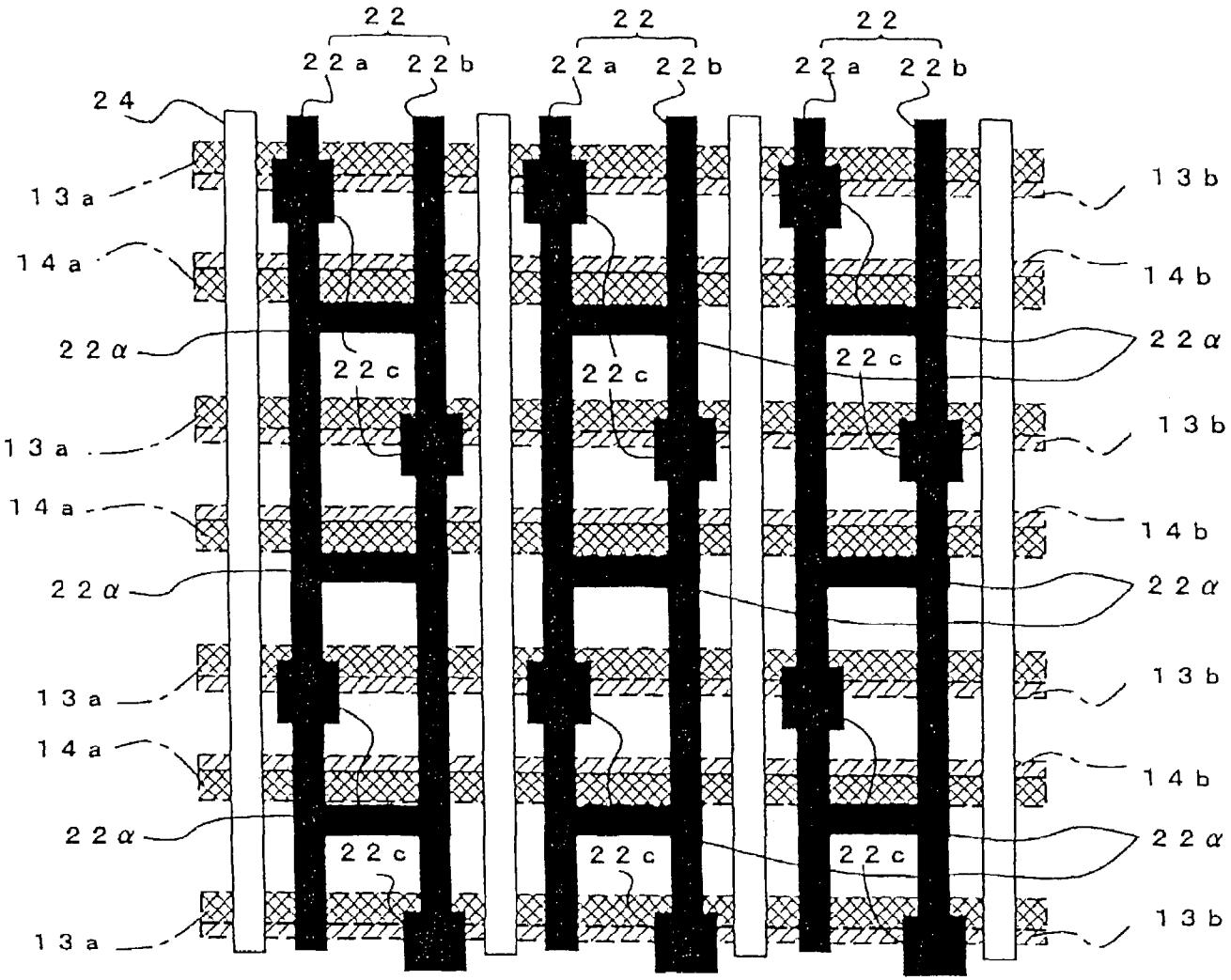
FIG. 7 is a view illustrating electrode structure on a rear substrate of a plasma display panel according to Embodiment 3 of the present invention.
Figure 8:
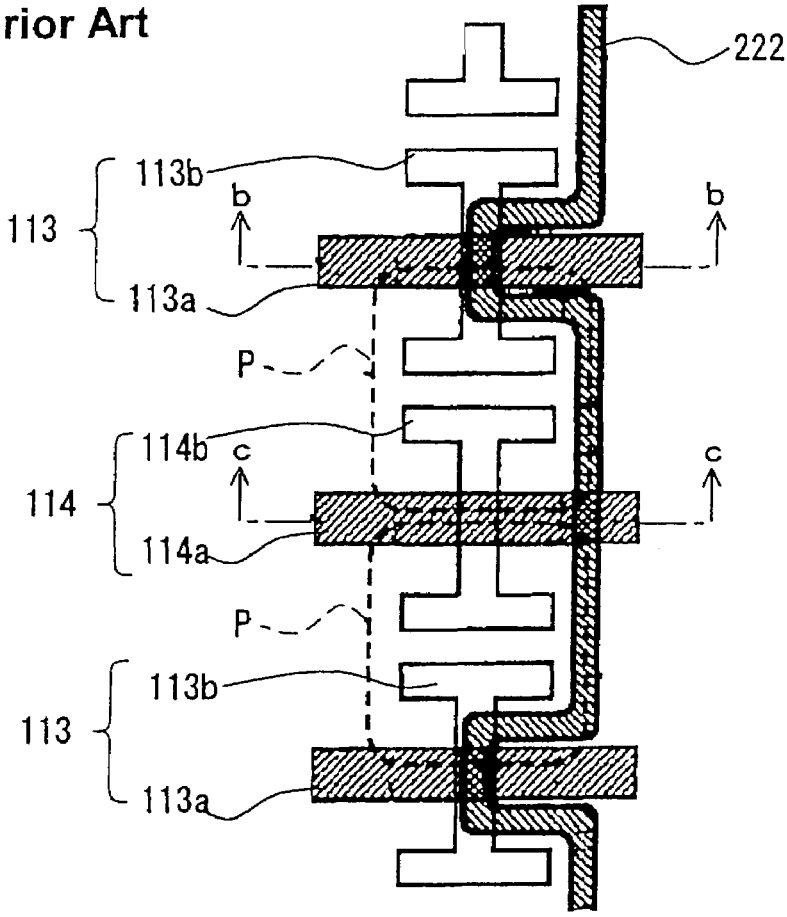
Fig. 8 (A) Prior Art
FIGS. 8(A), 8(B) and 8(C) are views illustrating positional relationship between main electrodes and address electrodes in a prior art plasma display panel.
Figure 8:
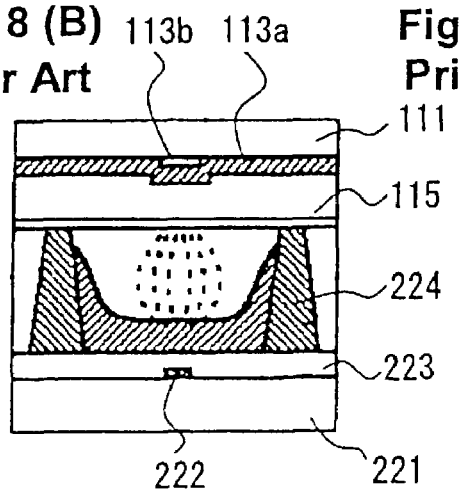
Fig. 8 (B) Prior Art
Figure 8:
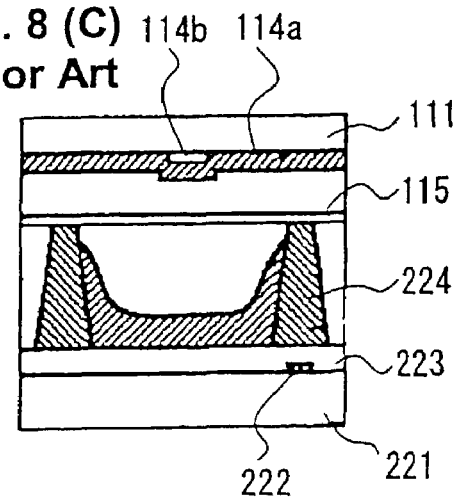
Fig. 8 (C) Prior Art
Figure 9:
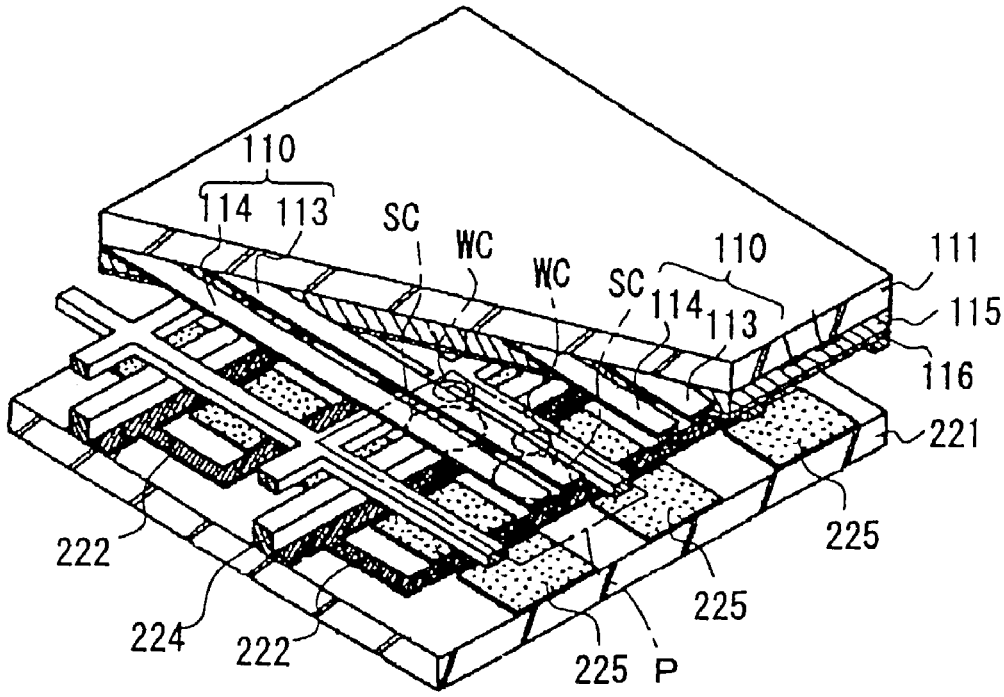
Fig. 9 Prior Art
FIG. 9 is a perspective view partially illustrating the prior art plasma display panel.

A plasma display panel according to Embodiment 3 of the present invention is described with reference to FIG. 7. FIG. 7 is a view illustrating electrode structure on a rear substrate of the plasma display panel according to this embodiment.

The plasma display panel according to this embodiment is constructed in the same manner as that of Embodiment 2 except that the branch electrodes 22*a* and 22*b* of the address electrode 22 formed between adjacent ribs 24 are connected in each unit light emitting region. The position of a junction 22α at which the branch electrodes 22*a* and 22*b* are connected comes into the middle of a portion of the branch electrode 22*a* corresponding to the second sustain electrode 13 and a portion of the branch electrode 22*b* corresponding to an adjacent sustain electrode 13. By providing the junction 22α at such a position, the branch electrodes 22*a* and 22*b* corresponding to the second sustain electrode 13 are free from the influence of negative charges generated in the branch electrodes 22*a* and 22*b* corresponding to an adjacent second sustain electrode 13 which has generated address discharge, thereby stable address discharge is caused.

The plasma display panel as constructed above according to this embodiment is operated in the same manner as described in Embodiment 1. However, since the branch electrodes 22*a* and 22*b* are connected, continuity is ensured even in the case of a break in part of the address electrode 22. Therefore, high reliability is achieved.

In the plasma display panels according to Embodiments 1 to 3, the address electrode 22 includes two branch electrodes 22*a* and 22*b*. However, three or more branch electrodes may be formed as the address electrode 22.

In the plasma display panel according to Embodiments 1 to 3, the address electrode 22 may overlap the first sustain electrode 14 in a smaller area to localize the address discharge in a region between the address electrode 22 and the second sustain electrode 13. Thereby, interference of the address discharge is inhibited, which allows reliable addressing.

In the plasma display panel according to Embodiments 1 to 3, transparent conductive films 13*b* and 14*b* may be formed on both sides of the sustain electrode pair 10 to cause discharge on both sides of the sustain electrodes.

As described above, according to the present invention, the address electrode between adjacent ribs includes a plurality of branch electrodes. Therefore, even in the case where address discharge is caused between one of the branch electrodes and the sustain electrode to generate charges in the branch electrode and decrease the potential level of the branch electrode, the other branch electrodes maintain a sufficient potential level. Thereby, stable address discharge occurs between the other branch electrodes and an adjacent sustain electrode.

Further, according to the present invention, the address electrode between adjacent ribs includes a plurality of branch electrodes and the branch electrodes each have a wide portion corresponding to each of the sustain electrodes. Therefore, even in the case where address discharge is caused between one of the branch electrodes and the sustain electrode to generate charges in the branch electrode, the charges are concentrated in the wide portion of the branch electrode and a sufficient potential level is maintained in the other branch electrodes. Thereby, stable address discharge occurs between the other branch electrodes and an adjacent sustain electrode.

Still further, according to the present invention, the address electrode between adjacent ribs includes a plurality of branch electrodes and the branch electrodes are connected. Therefore, stable address discharge is caused and continuity is ensured even in the case of a break in one of the branch electrodes. Thus, high reliability is achieved.

What is claimed is:

1. A plasma display panel comprising a first substrate carrying thereon a plurality of strip-shaped ribs arranged parallel to each other, a fluorescent material applied between adjacent ribs and a plurality of address electrodes arranged parallel to the ribs and a second substrate being arranged to oppose to the first substrate and carrying thereon a plurality of sustain electrodes arranged in a direction crossing the address electrodes, wherein each of the address electrodes between adjacent ribs is a plurality of branch electrodes which are diverged through almost the whole length of the ribs, and the branch electrodes formed between the adjacent ribs have wide portions corresponding to the sustain electrodes, respectively, and the wide portions of the branch electrodes are formed so as not to be adjacent to each other.

2. A plasma display panel comprising a first substrate carrying thereon a plurality of strip-shaped ribs arranged parallel to each other, a fluorescent material applied between adjacent ribs and a plurality of address electrodes arranged parallel to the ribs and a second substrate being arranged to oppose to the first substrate and carrying thereon a plurality of sustain electrodes arranged in a direction crossing the address electrodes, wherein each of the address electrodes between adjacent ribs is a plurality of branch electrodes which are diverged through almost the whole length of the ribs, and the branch electrodes formed between the adjacent ribs are connected in each unit light emitting region or in every two or more unit light emitting regions.

3. A plasma display panel according to claim 1, wherein the branch electrodes formed between the adjacent ribs are connected in each unit light emitting region or in every two or more unit light emitting regions.

* * * * *